US010813393B2

(12) United States Patent
Weber et al.

(10) Patent No.: US 10,813,393 B2
(45) Date of Patent: Oct. 27, 2020

(54) METHOD AND SYSTEM FOR MANUFACTURING FACEMASKS IN A PRODUCTION LINE

(71) Applicant: O&M Halyard, Inc., Mechanicsville, VA (US)

(72) Inventors: Joseph P. Weber, Suwanee, GA (US); Mark T. Pamperin, Cumming, GA (US); Anthony S. Spencer, Woodstock, GA (US); Eric C. Steindorf, Roswell, GA (US); David L. Harrington, Cumming, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 0 days.

(21) Appl. No.: 16/087,137

(22) PCT Filed: Oct. 4, 2017

(86) PCT No.: PCT/US2017/055031

§ 371 (c)(1),
(2) Date: Sep. 21, 2018

(87) PCT Pub. No.: WO2019/070248

PCT Pub. Date: Apr. 11, 2019

(65) Prior Publication Data

US 2020/0221795 A1 Jul. 16, 2020

(51) Int. Cl.

| | |
|---|---|
| ***A41D 13/11*** | (2006.01) |
| ***D05B 19/12*** | (2006.01) |
| ***D05B 27/12*** | (2006.01) |

(52) U.S. Cl.
CPC ..... *A41D 13/1161* (2013.01); *A41D 13/11* (2013.01); *D05B 19/12* (2013.01); *D05B 27/12* (2013.01)

(58) Field of Classification Search
CPC . A41D 13/11; A41D 13/1115; A41D 13/1161; A41D 13/1123; A62B 23/025
See application file for complete search history.

(56) References Cited

U.S. PATENT DOCUMENTS

| | | | |
|---|---|---|---|
| 5,724,677 | A | 3/1998 | Bryant et al. |
| 6,125,849 | A | 10/2000 | Williams et al. |
| 2011/0055998 | A1 | 3/2011 | Tai et al. |

FOREIGN PATENT DOCUMENTS

| | | | | |
|---|---|---|---|---|
| CA | 3001978 | A1 * | 4/2017 | ..... B29C 69/001 |
| CA | 3028171 | A1 * | 2/2019 | ..... B65B 25/20 |
| CN | 104 872 866 | B | 8/2016 | |
| KR | 100544894 | B1 | 1/2006 | |
| WO | WO 2017/111783 | A1 | 6/2017 | |

* cited by examiner

*Primary Examiner* — Tajash D Patel
(74) *Attorney, Agent, or Firm* — Dority & Manning, P.A.

(57) ABSTRACT

An automated system and method for the manufacture of facemasks from a web of a textile product in a production line is provided. The web is conveyed in the production line along a machine direction. A first tie is attached at a tie attaching station to the web of the textile product, such that the first tie extends from the web in a cross-machine direction perpendicular to the machine direction. The web and first tie are cut at a cutting station in the cross-machine direction across a width of the web in the cross-machine direction to form a facemask separate from the web.

16 Claims, 5 Drawing Sheets

METHOD AND SYSTEM FOR MANUFACTURING FACEMASKS IN A PRODUCTION LINE

CROSS-REFERENCED TO RELATED APPLICATIONS

This application is a national phase of and claims priority to PCT/US2017/055031, filed Oct. 4, 2017, the contents of which are incorporated herein by reference hereto.

FIELD OF THE INVENTION

The present invention relates generally to the field of protective facemasks, such as surgical facemasks, and more specifically to a method and system for manufacturing facemasks a production line.

BACKGROUND OF THE INVENTION

Various configurations of disposable filtering facemasks or respirators are known and may be referred to by various names, including "facemasks", "respirators", "filtering face respirators", "surgical facemasks", and so forth. For purposes of this disclosure, such devices are referred to herein generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 facemasks per minute. Current facemask production lines are capable of producing only about 100 facemasks per minute due to technology and equipment restraints, which falls far short of the estimated goal. Accordingly, advancements in the manufacturing and production processes will be needed if the goal of "on demand" facemasks during a pandemic is to become a reality.

Certain configurations of pleated facemasks include head fastening ties bonded to opposite edges of a rectangular body. Forming the rectangular bodies and attaching the ties may include cutting the web into the rectangular bodies, rotating the rectangular bodies, and then attaching the ties. For example, a web of textile material may be conveyed in a machine direction and pleats or folds may be formed extending in the machine direction. The web may then be cut at regular intervals along the cross-machine direction to form rectangular bodies. Each rectangular body may then be rotated 90 degrees with respect to the machine direction, and the ties may then be attached to the rectangular bodies along the left and right edges of the rectangular bodies with respect to the machine direction. Rotating the rectangular bodies and attaching the ties using the current manual and automated methods for manufacturing, however, is relatively slow. For mass production of facemasks at the throughputs mentioned above, it would be desirable to form the rectangular bodies and attach the ties while maintaining the high production speeds of the running line.

The present invention addresses this need and provides a method and related system for high speed manufacturing of facemasks from a web of a textile product in a production line.

SUMMARY OF THE INVENTION

Objects and advantages of the invention will be set forth in the following description, or may be obvious from the description, or may be learned through practice of the invention.

In accordance with aspects of the invention, an automated method is provided for manufacturing facemasks from a web of a textile product in a production line. The method includes conveying the web of the textile product in the production line along a machine direction. The method further includes attaching, at a tie attaching station, a first tie to the web of the textile product extending from the web in a cross-machine direction perpendicular to the machine direction. The method also includes cutting, at a cutting station, the web and the first tie in the cross-machine direction across a width of the web in the cross-machine direction to form a facemask separate from the web. In some embodiments, neither the web nor the facemask is rotated prior to attaching the first tie.

In a certain embodiment, attaching the first tie to the web includes attaching the first tie to a bottom face of the web opposite a top face of the web. The method may include attaching a second tie to the top face of the web such that the second tie extends in the cross-machine direction and overlaps the first tie. The method may include attaching the second tie to the first tie. Further, the first tie and second tie may be attached to the web using ultrasonic bonding.

In another embodiment, the method may include feeding the web onto a circumferential surface of a rotating wheel at a web feeding station upstream of the tie attaching station with respect to the machine direction. The method may also include temporarily securing the first tie to the circumferential surface of the rotating wheel at a first tie arranging station before feeding the web onto the circumferential surface of the rotating wheel at the web feeding station. The first tie may be temporarily secured to the circumferential surface of the rotating wheel by a suction device associated with the rotating wheel. Feeding the web onto the rotating wheel may include conveying the web on top of the first tie such that the bottom face of the web contacts the first tie. The method may further include arranging the second tie on the top face of the web such that the second tie extends in the cross-machine direction and overlaps the first tie. The method may further include temporarily securing the second tie on the top face of the web using a suction device associated with the rotating wheel.

In some embodiments, the method may include cutting the first tie along a center line of the first tie to form a trailing tie on a first facemask and a leading tie on a second facemask. The cutting station may be disposed downstream of the tie attaching station with respect to the machine direction such that the first tie is attached to the web before each of the web and first tie is cut across the width of the web in the cross-machine direction. The step of cutting the web and the first tie to form the facemask may be repeatedly performed at a rate such that facemasks are formed at a rate between about 200 facemasks per minute and about 700 facemasks per minute.

In accordance with aspects of the invention, an automated system is provided for manufacturing facemasks from a web of a textile product in a production line. The system includes a conveyor system on which the web of the textile product is conveyed along a machine direction. The system also includes a tie attaching station configured to attach a first tie to the web of the textile product such that the first tie extends from the web in a cross-machine direction perpendicular to the machine direction. The system also includes a cutting station at or downstream of the tie attaching station in the machine direction, and the cutting station is configured to cut each of the web and the first tie along a length of the first tie in the cross-machine direction. In some embodiments, the tie attaching station may include an ultrasonic bonder.

In addition, in some embodiments, the cutting station may include a cutting drum and a blade, and the cutting drum may be rotatably mounted about an axis extending in the cross-machine direction. The blade may be attached to an outer circumferential surface of the rotating cutting drum and extends in the cross-machine direction. In some embodiments, the cutting station may be downstream of the tie attaching station with respect to the machine direction.

In a certain embodiment, the conveyor system may include a rotating wheel having a circumferential surface and being rotatable about an axis extending in the cross-machine direction. In some embodiments, the rotating wheel may include a suction device having an inlet disposed adjacent the outer circumferential surface of the rotating wheel. As used herein, "adjacent" means near, proximate, or on. The conveyor system may further include a linear conveyor located adjacent the rotating wheel and configured to feed the web onto the rotating wheel at a web feeding station. The tie attaching station may be disposed adjacent an outer circumferential surface of the rotating wheel and downstream of the web feeding station with respect to the machine direction.

In accordance with aspects of the invention, an automated system is provided for manufacturing facemasks from a web of a textile product in a production line. The system includes a conveying means for conveying the web of the textile product in a machine direction. The system includes an attaching means for attaching a first tie to the web of the textile product such that the first tie extends from the web in a cross-machine direction perpendicular to the machine direction. The system includes a cutting means for cutting each of the web and the first tie across a width of the web and along a length of the first tie in the cross-machine direction, and the cutting means is disposed at or downstream of the attaching means in the machine direction.

In some embodiments, the system may include a rotating wheel having a circumferential surface and a first tie arranging means for arranging a first tie on the circumferential surface such that the first tie extends in the cross-machine direction. The system may also include a web feeding means for feeding the web onto the circumferential surface of the rotating wheel on top of the first tie on the circumferential surface. The system may also include a second tie arranging means for arranging a second tie on a face of the web such that the web is disposed between the first tie and the second tie. The web feeding means may be located downstream of the first tie arranging means with respect to the machine direction. The second tie arranging means may be located downstream of the web feeding with respect to the machine direction. The attaching means may be located downstream of the web feeding means with respect to the machine direction. The cutting means may be located downstream of the attaching means with respect to the machine direction.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Figure 1:
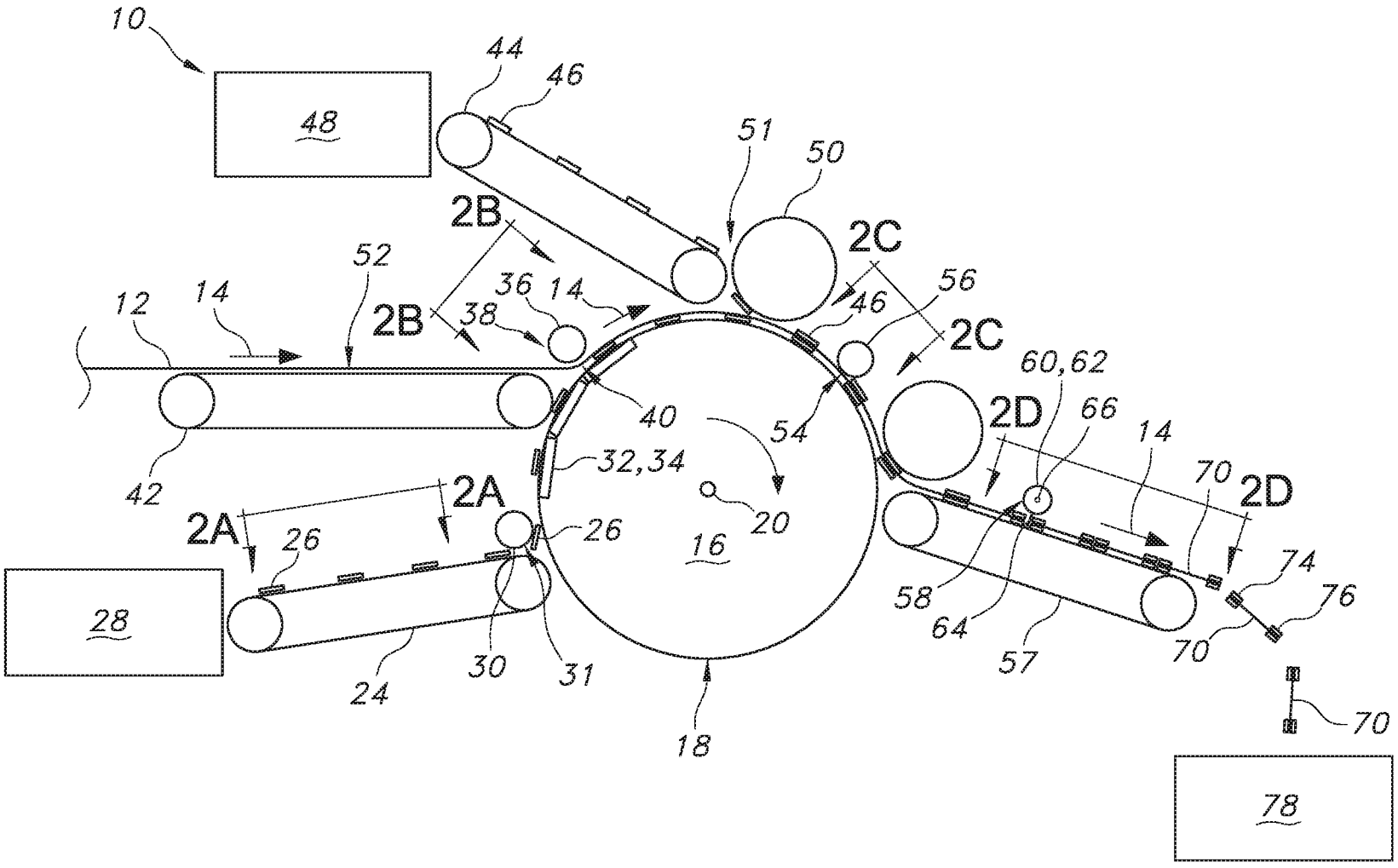
FIG. 1 is a side diagram view of one embodiment of a system for manufacturing facemasks in accordance with aspects of the present disclosure.

Referring to FIG. 1, one embodiment of an automated system 10 is depicted for manufacturing facemasks 70 from a web 12 of a textile product in a production line. The system 10 may a conveyor system or conveyor means on which the web of the textile product is conveyed along a machine direction 14. Generally, the conveyor system may include rollers having a cylindrical shape, and the web 12 may contact the rollers around a portion of their respective circumferences. Alternatively, the conveyor system may include any suitable manner of article conveyor, including, for example, vacuum conveyors. For purposes of this invention, the term "textile product" includes a web that has a structure of individual fibers or threads which are interlaid, but not in an identifiable, repeating manner—commonly referred to as a "nonwoven web". Nonwoven webs have been, in the past, formed by a variety of processes such as, for example, meltblowing processes, spunbonding processes and bonded carded web processes. The term "meltblown fibers" means fibers formed by extruding a molten thermoplastic material through a plurality of fine, usually circular, die capillaries as molten threads or filaments into a high velocity gas (e.g. air) stream which attenuates the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. The term "spunbonded fibers" refers to small diameter fibers which are formed by extruding a molten thermoplastic material as filaments from a plurality of fine, usually circular, capillaries of a spinnerette with the diameter of the extruded filaments then being rapidly reduced as by, for example, eductive drawing or other well-known spunbonding mechanisms.

The conveyor system, or conveyor means, may include a rotating wheel 16, which may have a circumferential surface 18 and may be rotatable about an axis 20 extending in a cross-machine direction 22, which is perpendicular to the machine direction 14. Because FIG. 1 is a side diagram view, the cross-machine direction 22 extends into the viewing plane of FIG. 1 (see FIG. 2*a* along Section A-A).

Figure 2A:
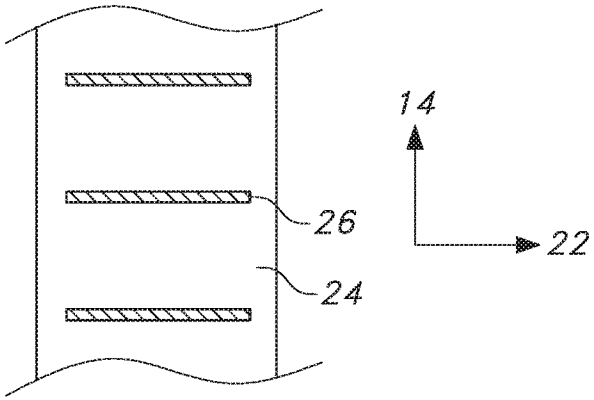
FIGS. 2*a*-2*d* are section views along Sections A-A, B-B, C-C, and D-D, respectively, in FIG. 1.

The system 10 may also include a first linear conveyor 26 configured to convey a first tie 26 from a first tie source 28 to the rotating wheel 16. For example, the first linear conveyor 24 may be configured to convey a series of evenly spaced first ties 26 from the first tie source 28 to the rotating wheel 16. FIG. 2*a* illustrates a view along Section A-A in FIG. 1. Referring to FIG. 2*a*, the first ties 26 may be evenly spaced in the machine direction 14 on the first linear conveyor 24.

Referring to FIG. 1, the system 10 may also include a first tie arranging means 30 for arranging a first tie 26 on the circumferential surface 18 such that the first tie 26 extends in the cross-machine direction 22 (see FIG. 2*a*). The first tie arranging means 30 may be located at a first tie arranging station 31. In some embodiments, the first tie arranging means 30 may include a roller disposed adjacent both the first linear conveyor 24 and the rotating wheel 16 such that the roller forces the first tie 26 onto the surface of the rotating wheel 16. In other embodiments the first tie arranging means 30 may include a robotic arm (similar to that shown in FIG. 4) configured to pick up the first tie 26 from the first linear conveyor 24 and place it on the circumferential surface 18 of the rotating wheel 16.

The rotating wheel 16 may include a temporary securing means 32 for temporarily securing the first tie 26 on the circumferential surface. For example, the rotating wheel 16 may include a suction device 34 having an inlet disposed adjacent the outer circumferential surface 18 of the rotating wheel 16. A vacuum may be drawn in the suction device 34 via a control/suction line fluidly connected with a vacuum source, such as a pump. The rotating wheel 16 may include multiple suction devices 34, as shown in FIG. 1. For example, the rotating wheel 16 may include suction devices 34 disposed in an evenly spaced array around the outer circumferential surface 18. In other embodiments, the temporary securing means 32 may include clips, robotic arms, adhesive surfaces, and/or any other suitable means to temporarily secure the first tie 26 on the circumferential surface 18.

Figure 2B:
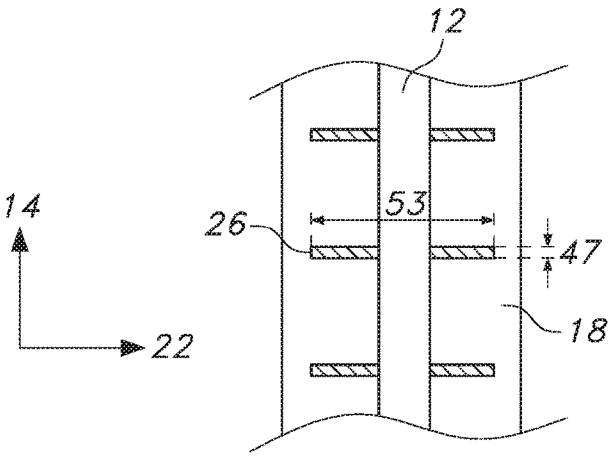

The conveyor system 10 may further include a web feeding means 36 configured to convey the web 12 onto the circumferential surface 18 of the rotating wheel 16 at a web feeding station 38. For example, the web feeding means 36 may convey the web 12 on top of the first tie 26 such that a bottom face 40 of the web 12 contacts the first tie 26. In some embodiments, the conveyor system may include a second linear conveyor 42 located adjacent the rotating wheel 16 and configured to feed the web 12 onto the rotating wheel 16 at the web feeding station 38. The web feeding means 36 may include a roller disposed adjacent both the rotating wheel 16 and the second linear conveyor 42. FIG. 2*b* illustrates a section view along Section B-B in FIG. 1. The web feeding means 36 is omitted for clarity. As illustrated in FIG. 2*b*, at the web feeding station 38, the web 12 may be conveyed on top of the first tie 26 such that the bottom face 40 of the web 12 contacts the first tie 26, and the first tie 26 is between the web 12 and the circumferential surface 18 of the rotating wheel 16. The web 12 and first tie 26 may travel around a portion of the circumferential surface 18 of the rotating wheel 16.

Further, when referring to the embodiment illustrated in FIG. 1, it is to be understood that the machine direction 14 may be relative to the direction in which the web 12 is moving. Thus, along the circumferential surface 18 of the rotating wheel 16, the machine direction 14 is tangential to the circumferential surface 18. Along the first linear conveyor 24, however, the machine direction 14 is parallel to a surface of the particular linear conveyor on which the web is conveyed. Similarly the cross-machine direction 22 is perpendicular to the machine direction 14. Because FIG. 1 is a side diagram view the cross-machine direction 22 extends into the viewing plane of the FIG. 1 (see FIG. 2*a*).

Referring to FIG. 1, the conveyor system may further include a third linear conveyor 44 configured to convey a second tie 46 from a second tie source 48 to the rotating wheel 16. For example, the second linear conveyor 42 may be configured to convey a series of evenly spaced second ties 46 from the second tie source 48 to the rotating wheel 16. The system 10 may also include a second tie arranging means 50 for arranging the second tie 46 on the circumferential surface 18 at a second tie arranging station 51. For example, the second tie arranging means 50 may arrange the second tie 46 on a top face 52 of the web 12 such that the second tie 46 extends in the cross-machine direction 22 and/or overlaps the first tie 26 (see FIG. 2*c*).

For example, the second tie arranging means 50 may include a roller disposed adjacent both the third linear conveyor 44 and the rotating wheel 16 such that the roller forces the second tie 46 onto the circumferential surface 18 of the rotating wheel 16. In other embodiments the second tie arranging means 50 may include a robotic arm (see FIG. 4) configured to pick up the second tie 46 from the third linear conveyor 44 and place the second tie 46 on the circumferential surface 18 of the rotating wheel 16. For example, the second tie arranging means 50 may be configured to arrange the second tie 46 on the top face 52 of the web 12 such that the second tie 46 overlaps a portion of the first tie 26, or, in some embodiments, overlaps all of the first tie 26.

Figure 2C:
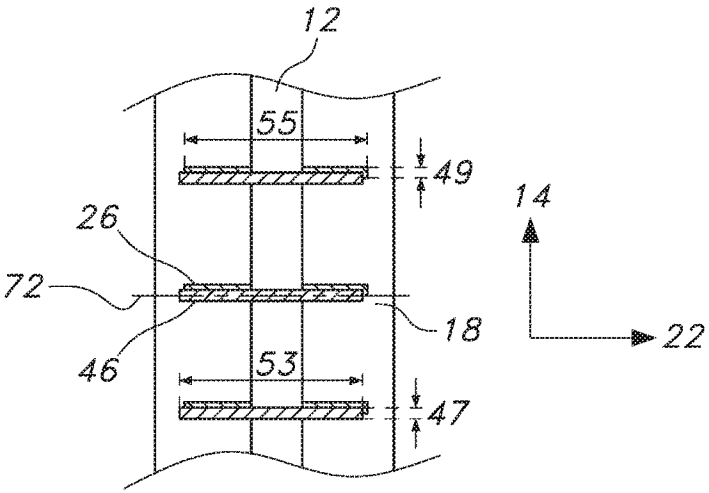

FIG. 2*c* illustrates a view along Section C-C in FIG. 1. FIG. 2*c* illustrates the web 12 disposed between the first tie 26 and the second tie 46. As shown in FIG. 2*c*, the second tie 46 may be located on the top face 52 of the web 12, which may be on top of the first tie 26. As noted above, the first tie 26 may be temporarily secured to the circumferential surface 18 of the rotating wheel 16 using the temporary securing means 32. The temporary securing means 32 (shown in FIG. 1 and discussed below) is omitted from FIG. 2*c* for clarity. In some embodiments, the first tie 26 and the second tie 46 may overlap in each of the machine direction 14 and cross-machine direction 22. For example, in some embodiments, the first tie 26 may overlap the second tie 46 across the majority of a width 47 of the first tie 26 in the machine direction 14. In some embodiments, second tie 46 may have a width 49 approximately equal to the width 47 of the first tie 26, and the edges of the first and second ties 26, 46 in the machine direction 14 may be substantially aligned. Similarly, the first tie 26 may have a length 53 approximately equal to a length 55 of the second tie 46 such that the ends of the first and second ties 26, 46 in the cross-machine direction may be substantially aligned and the second tie 46 covers the first tie 26. In other embodiments, however, the first and second ties 26, 46 may not completely overlap. For example, in some embodiments, the first and second ties 26, 46 may overlap across less than half of the width 47 of the first tie 26 in the machine direction 14 as illustrated in FIG. 2*c*. Similarly, in some embodiments, the ends of the first and second ties 26, 46 may be offset in the cross-machine direction 22 as illustrated in FIG. 2*c*.

Referring to FIG. 1, the system may also include a tie attaching means 56 at a tie attaching station 54. The tie attaching means 56 may be disposed adjacent the outer circumferential surface 18 of the rotating wheel 16 and downstream of the web feeding station 38 with respect to the machine direction 14. The tie attaching means 56 may be configured to attach the first tie 26 to the web 12 such that the first tie 26 extends from the web 12 in a cross-machine direction 22 perpendicular to the machine direction 14, as illustrated in FIG. 2*c*. The tie attaching means 56 may also be configured to attach the first tie 26 to the second tie 46. For example, in some embodiments, the tie attaching means 56 may include an ultrasonic bonder. In other embodiments, the tie attaching means 56 may be configured to attach the first tie 26 to the web 12 and/or the second tie 46 using any suitable technique. For example, the tie attaching means 56 may melt or stitch the fabrics together. For example, in other embodiments, the tie attaching means 56 may apply and/or cure an adhesive between the fabrics.

The system may also include a cutting station 58 including a cutting means 60. In some embodiments, the cutting means 60 may be disposed adjacent a fourth linear conveyor 57, and the rotating wheel 16 may convey the web 12 onto the fourth linear conveyor 57 after the tie attaching means 56 attaches the ties 26, 46. In other embodiments, the cutting station 58 may be disposed adjacent the rotating wheel 16. In some embodiments, the cutting means 60 and cutting station 58 may be located at or downstream of the tie attaching station 54 in the machine direction 14.

Figure 2D:
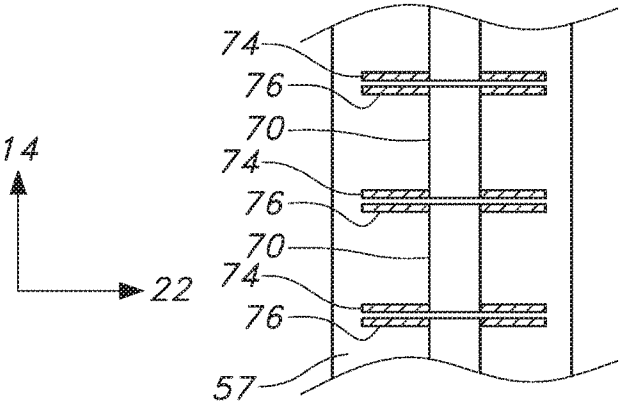

The cutting means 60 may be configured to cut each of the web 12 and the first tie 26 along the length 53 of the first tie 26 in the cross-machine direction 22 (see FIG. 2*d*). In some embodiments, the cutting means 60 may be configured to cut each of the web 12 and the second tie 46 along the length 55 of the second tie 46 in the cross-machine direction 22 (see FIG. 2*d*). For example, the cutting means 60 may include a cutting drum 62 and a blade 64. The cutting drum 62 may be rotatably mounted about an axis extending in the cross-machine direction 22. The blade 64 may be attached to an outer surface of the rotating cutting drum such that a length of the blade extends in the cross-machine direction 22. As the web 12 passes through the cutting station 58 the cutting drum 62 may rotate at a speed associated with the rate of the web 12 such that the cutting drum 62 cuts each of the web 12 and the first tie 26 along the length 53 of the first tie 26 in the cross-machine direction 22. As indicated above, in some embodiments, the cutting drum 62 may cut each of the web 12 and the second tie 46 along the length 55 of the second tie 46 in the cross-machine direction 22.

FIG. 2*d* illustrates a view along Section D-D in FIG. 1. As illustrated in FIG. 2*d*, the cutting means 60 may be configured to cut the web 12 and first tie 26 to form a facemask 70. For example, in some embodiments, the first tie 26 may have a center line 72 extending in the cross-machine direction 22, and the cutting means 60 may be configured to cut each of the web 12 and the first tie 26 along the center line 72 of the first tie 26. Cutting the web 12 and first tie 26 may form a trailing tie 74 on one of the facemasks 70 and a leading tie 76 on an adjacent facemask 70. In some embodiments, the cutting means 60 may also be configured to cut the second tie 46 such that a portion of the second tie 46 is associated with the leading tie 76 and a portion of the second tie 46 is associated with the trailing tie 74. As shown in FIG. 2*d*, this may result in each facemask 70 having a respective leading tie 76 and a respective trailing tie 74.

Referring to FIG. 1, after the cutting means 60 cuts the web 12 and the first tie 26 to form the facemask 70 separate from the web 12, the facemask 70 may be further processed and/or packaged. For example, the facemasks 70 may collect in a container 78. In other embodiments, additional packaging steps may be completed before the facemasks 70 are deposited or arranged within a package, or container 78 for shipping.

Referring to FIG. 1, in some embodiments, the web feeding means 36 may be located downstream of the first tie arranging means 30 with respect to the machine direction 14. In some embodiments, the second tie arranging means 50 may be located downstream of the web feeding means 36 with respect to the machine direction 14. In some embodiments, the tie attaching means 56 may be located downstream of the web feeding means 36 with respect to the machine direction 14. In some embodiments, the cutting means 60 may be located downstream of the tie attaching means 56 with respect to the machine direction 14. In some embodiments, the cutting station 58 may be located downstream of the tie attaching station 54 with respect to the machine direction 14 such that the first tie 26 is attached to the web 12 before each of the web 12 and first tie 26 is cut across the width of the web 12 in the cross-machine direction 22.

Figure 3:
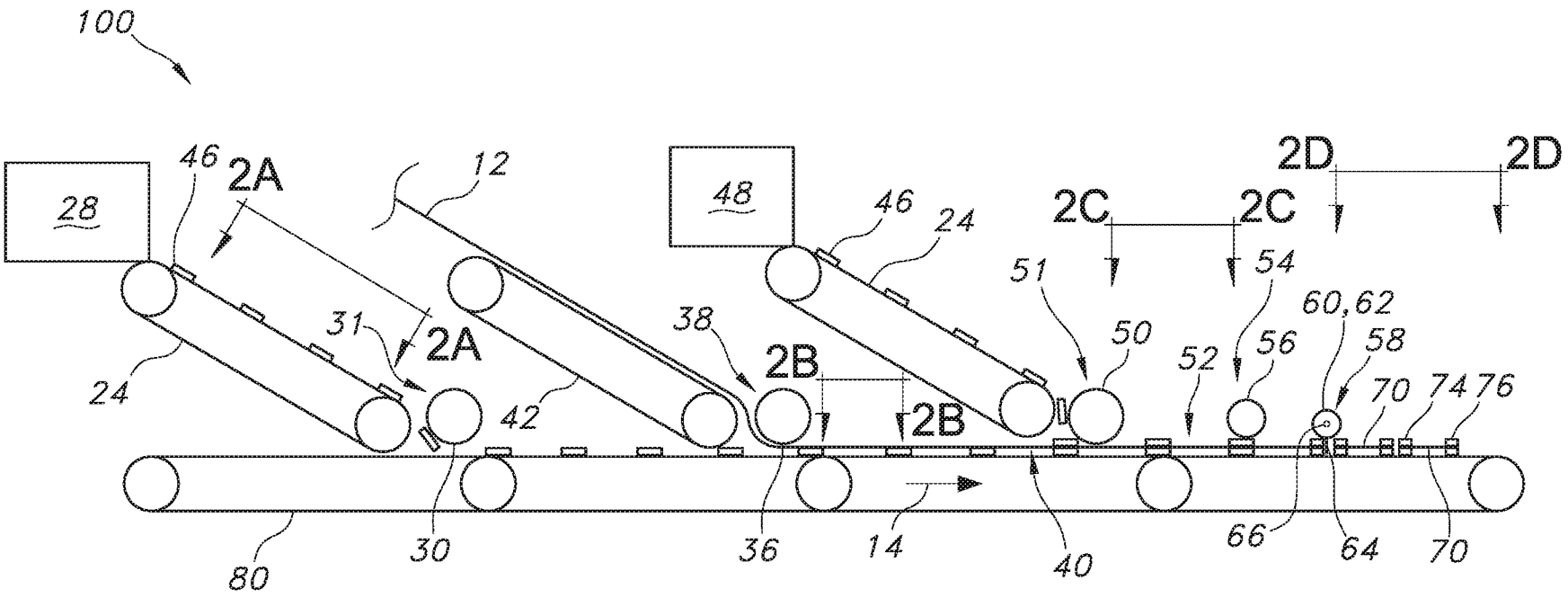
FIG. 3 is a side diagram view of another embodiment of a system for manufacturing facemasks in accordance with aspects of the present disclosure.

In some embodiments, the system 100 may not include a rotary wheel 16. Referring to FIG. 3, the system 100 may similarly include a first tie arranging station 31, web feeding station 38, second tie arranging station 51, tie attaching station 54, and/or cutting station 58. The various stations may be generally configured with respective means as described above. In this embodiment, however, the various stations may be arranged along a main conveyor 80 or series of conveyors. In this embodiment, the first tie arranging station 31 may similarly include a first tie arranging means 30 for arranging the first tie 26. The first tie arranging means 30 may be a roller or robotic arm, for example, configured to arrange the first tie on a surface of the conveyor. The first tie arranging means 30 may function similarly to the first tie arranging means 30 described in the embodiment illustrated in FIG. 1. The web feeding station 38 may include a web feeding means 36 configured to feed the web 12 onto the main conveyor 80 on top of the first tie 26. The web feeding means 36 may function similarly to the web feeding means 36 described in the embodiment illustrated in FIG. 1. The second tie arranging station 51 may include a second tie arranging means 50 configured to arrange the second tie 46 on top of the web 12 and second linear conveyor 42. The second tie arranging means 50 may function similarly to the second tie arranging means 50 described in the embodiment illustrated in FIG. 1. FIGS. 2*a*-2*d* explained with reference to FIG. 1 may similarly represent section views of along Sections A-A, B-B, C-C, and D-D, respectively, in FIG. 1. However, for the embodiment illustrated in FIG. 3, each of the support structures on which the web 12, first tie 26, and second tie 46, are shown (e.g., the first linear conveyor in FIG. 2*a*, the outer circumferential surface in FIG. 2*b*, etc.) would instead correspond to the main conveyor 80.

In some embodiments, the system 10 or system 100 may include a controller (not shown) configured to monitor and control the performance of the tie manufacturing process. The controller may include one or more processor(s) and associated memory devices configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits.

Additionally, the memory device(s) of each controller may generally comprise memory element(s) including, but not limited to, computer readable medium (e.g., random access memory (RAM)), computer readable non-volatile medium (e.g., a flash memory), a compact disc-read only memory (CD-ROM), a magneto-optical disk (MOD), a digital versatile disc (DVD) and/or other suitable memory elements. Such memory device(s) may generally be configured to store suitable computer-readable instructions that, when implemented by the processor(s) configure each controller to perform various computer-implemented functions.

In some embodiments, the controller may be configured to control the speed or performance of at least one of the first linear conveyor 24, first tie arranging means 30, second linear conveyor 42, rotating wheel 16, web feeding means 36, third linear conveyor 44, second tie arranging means 50, tie attaching station 54, second tie arranging means 56, or cutting station 58. For example, in some embodiments, the controller may be configured to control the operation of the second tie arranging means 50 such that the second tie arranging means 50 may align the second tie 46 to overlap with the first tie 26 as explained above. For example, referring to FIG. 4, in one embodiment, the second tie arranging means 50 may include a sensor 82 (e.g., a visual sensor such as a camera) configured to sense the position of the first tie 26. The controller may be communicatively coupled with the sensor 82, and configured to control the operation of the second tie arranging means 50 based on signals received from the sensor 82. For example, in some embodiments, the second tie arranging means 50 may be a roller, and the controller may control the speed of one or more of the roller and the third linear conveyor 44 based on signals received from the sensor 82 such that the second ties 46 are placed on the web 12 completely overlapping the first ties 26, partially overlapping the first ties 26, or any other desired configuration, such as described above with reference to the embodiment of the system 10 illustrated in FIG. 1.

Figure 4:
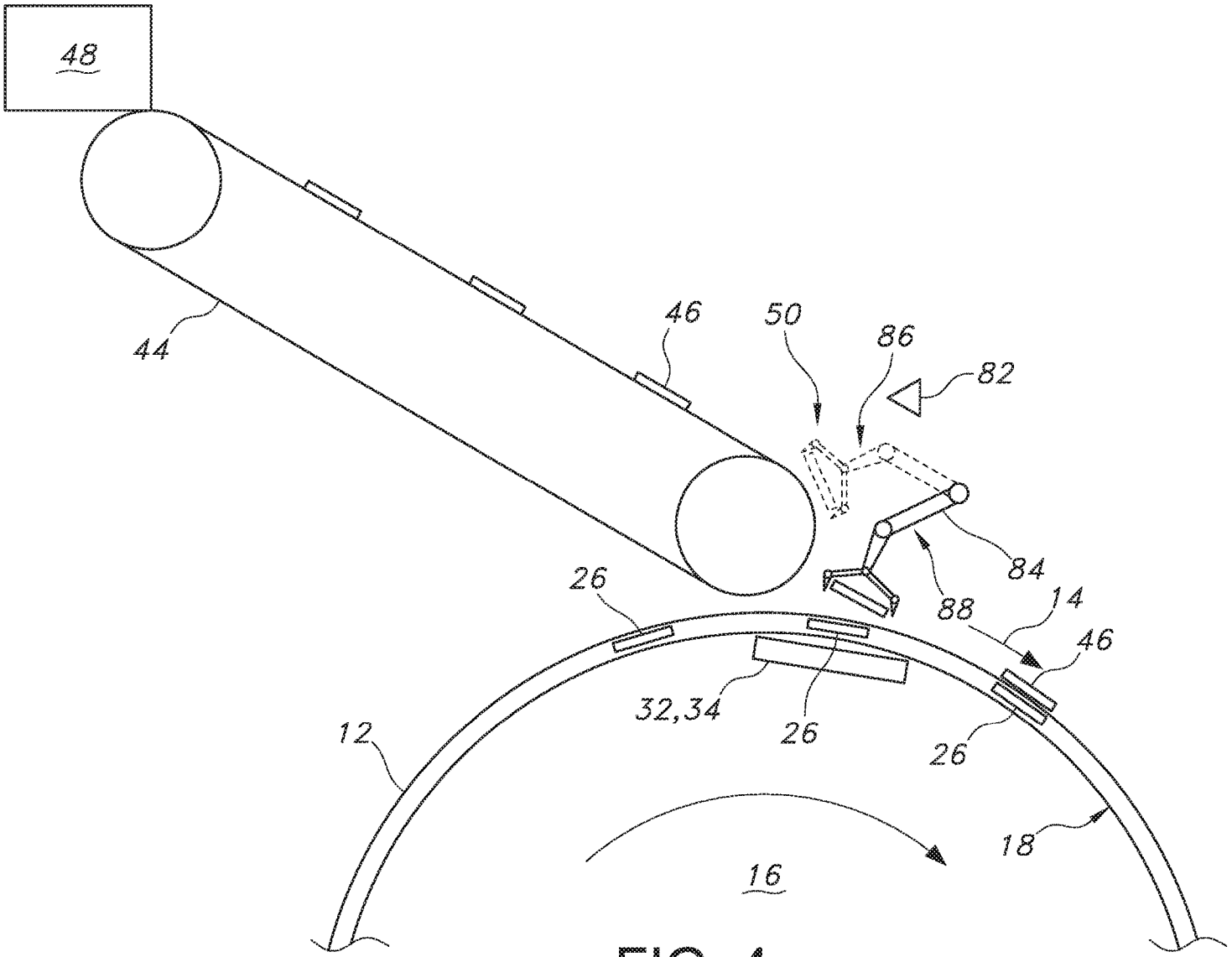
FIG. 4 is a side diagram view of a portion of the embodiment illustrated in FIG. 1.

Referring to FIG. 4, in other embodiments, the second tie arranging means 50 may include a robotic arm 84, and the controller may be configured to control the movement of the robotic arm 84 based on the signals received from the sensor 82. For example, the controller may be communicatively coupled with one or more servos or actuators associated with the robotic arm 84. The robotic arm 84 may be movable between a first position 86 (shown in dotted lines), in which the robotic arm 84 may pick up one of the second ties 46, and a second position 88, in which the robotic arm 84 places the second tie 46 on the circumferential surface 18 and on top of the web 12 and first tie 26.

Further it is to be understood that although the conveyors 24, 42, 44, 57 have been referred to as "linear" conveyors herein, any suitable configuration of conveyor may be used. For example, in some embodiments, one or more of the linear conveyors 24, 42, 44, 57 may be a rotating conveyor, similar to the rotating wheel 16 and may similarly include suction devices 34 for securing various components of the facemasks 70 to the respective circumferential surfaces 18 of the rotating conveyors.

In some embodiments, the system 10 or system 100 may not include the second tie arranging means 50, the second tie arranging station 51, and/or the second tie 46. For example, in such an embodiment, the system 10 may be configured to attach ties to only one side of the web 12. For example, in one embodiment, the system 10 may be configured to attach ties only to the bottom face 40 of the web 12. In another embodiment, however, the system may be configured to attach ties to only the top face 52 of the web 12 without attaching any ties to the bottom face 40 of the web 12. For example, in such an embodiment, the first tie arranging means 30 may be disposed downstream of the web feeding means 36 such that the first ties 26 are arranged and attached along the top face 52 of the web 12. One of ordinary skill in the art would understand that still other variations are possible based on the disclosure herein.

Figure 5:
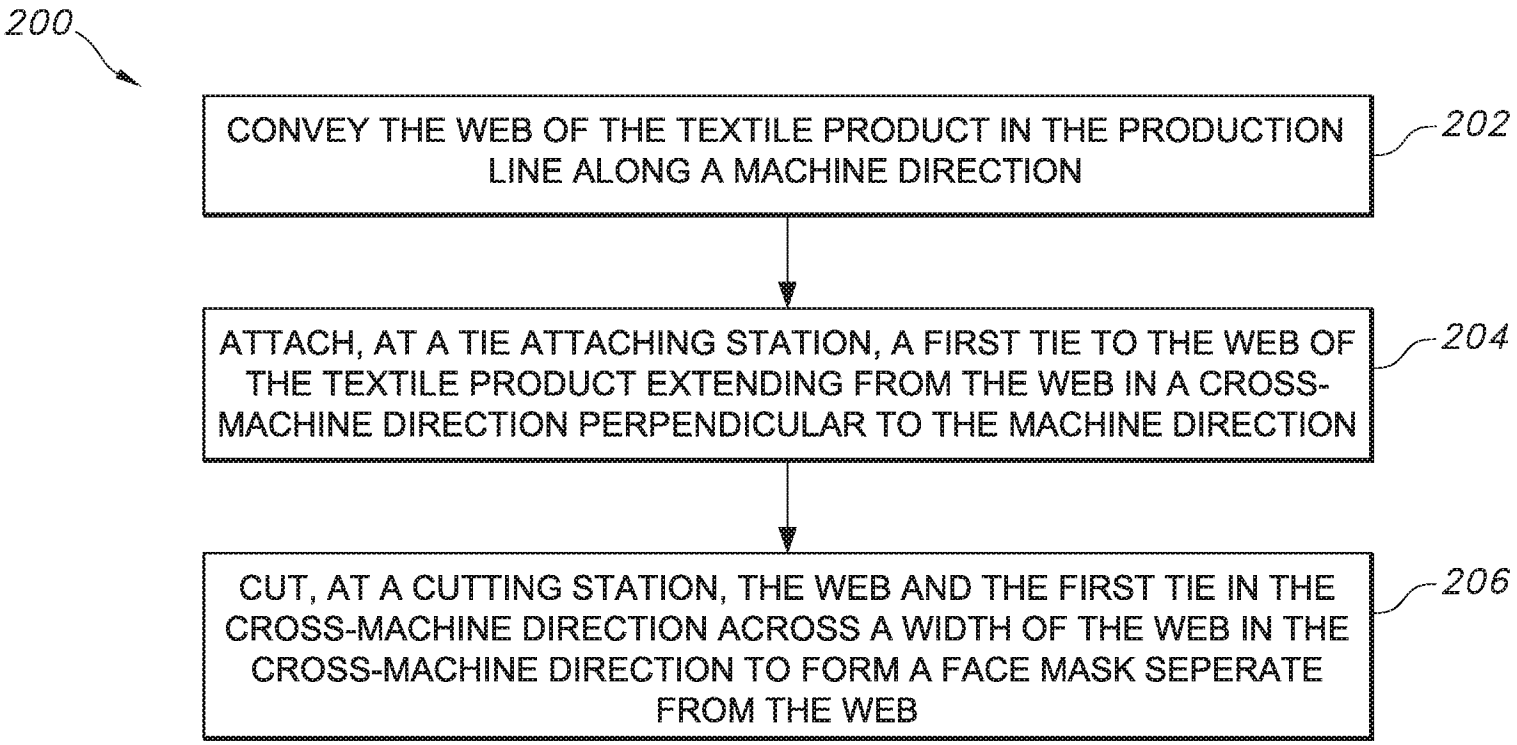
FIG. 5 is a flowchart of a method for manufacturing facemasks in accordance with aspects of the present disclosure.

Referring to FIG. 5, an automated method 200 for manufacturing facemasks from a web of a textile product in a production line. Although described with reference to the embodiments described above, the automated method 200 is not limited to those embodiments. In addition, although FIG. 5 depicts steps performed in a particular order for purposes of illustration and discussion, the method 200 is not limited to any particular order or arrangement. One skilled in the art, using the disclosures provided herein, will appreciate that various steps of the method 200 can be omitted, rearranged, combined, and/or adapted in various ways without deviating from the scope of the present disclosure.

The method 200 may include, at (202), conveying the web 12 of the textile product in the production line along a machine direction 14. The method 200 may also include, at (204) attaching, at a tie attaching station 54, a first tie 26 to the web 12 of the textile product extending from the web 12 in a cross-machine direction 22 perpendicular to the machine direction 14. The method 200 may also include, at (206) cutting, at a cutting station 58, the web 12 and the first tie 26 in the cross-machine direction 22 across a width of the web 12 in the cross-machine direction 22 to form a facemask 70 separate from the web 12. In some embodiments, neither the web 12 nor the facemask 70 may be rotated prior to attaching the first tie 26. In some embodiments the attaching step, at (204), may be performed before the cutting step, (at 206).

The method 200 may be performed at such a rate that facemasks are manufactured at a rate of least 200 facemasks per minute. More specifically, the step of cutting the web and the first tie to form the facemask may be repeatedly performed at a rate such that facemasks are formed at a rate between about 200 facemasks per minute and about 700 facemasks per minute. For example, in some embodiments, the method 200 may be performed such that facemasks are formed at a rate between about 300 facemasks per minute and about 600 facemasks per minute, and, in some embodiments, at a rate between about 400 facemasks per minute and about 500 facemasks per minute.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. An automated method for manufacturing facemasks from a web of a textile product in a production line, comprising:

conveying the web of the textile product in the production line along a machine direction;

attaching, at a tie attaching station, a first tie to the web of the textile product in a cross-machine direction such that the first tie extends in the cross-machine direction, wherein the cross-machine direction is perpendicular to the machine direction; and cutting, at a cutting station, the web and the first tie in the cross-machine direction across a width of the web in the cross-machine direction to form a facemask separate from the web.

2. The automated method of claim 1, wherein the cutting station is disposed downstream of the tie attaching station with respect to the machine direction.

3. The automated method of claim 1, wherein neither the web nor the facemask is rotated prior to attaching the first tie.

4. The automated method of claim 1, wherein attaching the first tie to the web includes attaching the first tie to a bottom face of the web opposite a top face of the web.

5. The automated method of claim 4, further comprising attaching a second tie to the top face of the web such that the second tie extends in the cross-machine direction and overlaps the first tie.

6. The automated method of claim 5, wherein attaching the first tie to the web includes ultrasonically bonding the first tie to the web, and wherein attaching the second tie to the web includes ultrasonically bonding the second tie to the web.

7. The automated method of claim 4, further comprising attaching the second tie to the first tie.

8. The automated method of claim 1, further comprising feeding the web onto a circumferential surface of a rotating wheel at a web feeding station upstream of the tie attaching station with respect to the machine direction.

9. The automated method of claim 8, further comprising temporarily securing the first tie to the circumferential surface of the rotating wheel at a first tie arranging station before feeding the web onto the circumferential surface of the rotating wheel at the web feeding station.

10. The automated method of claim 9, wherein the first tie is temporarily secured to the circumferential surface of the rotating wheel by a section device associated with the rotating wheel.

11. The automated method of claim 9, wherein feeding the web onto the rotating wheel includes conveying the web on top of the first tie such that the bottom face of the web contacts the first tie.

12. The automated method of claim 11, further comprising arranging the second tie on the top face of the web such that the second tie extends in the cross-machine direction and overlaps the first tie.

13. The automated method of claim 11, further comprising temporarily securing the second tie on the top face of the web using a suction device associated with the rotating wheel.

14. The automated method of claim 1, wherein cutting each of the web and the first tie includes cutting the first tie along a center line of the first tie to form a trailing tie on a first facemask and a leading tie on a second facemask.

15. The automated method of claim 1, wherein the cutting station is disposed downstream of the tie attaching station with respect to the machine direction such that the first tie is attached to the web before each of the web and first tie is cut across the width of the web in the cross-machine direction.

16. The automated method of claim 1, wherein the step of cutting the web and the first tie to form the facemask is repeatedly performed at a rate such that facemasks are formed at a rate between about 200 facemasks per minute and about 700 facemasks per minute.

* * * * *